United States Patent [19]

Schneider et al.

[11] Patent Number: 4,807,691

[45] Date of Patent: Feb. 28, 1989

[54] MOLD FOR CONTINUOUS CASTING OF METAL

[75] Inventors: Heinz Schneider; Franz Spona, both of Duisburg, Fed. Rep. of Germany

[73] Assignee: Mannesmann AG, Duesseldorf, Fed. Rep. of Germany

[21] Appl. No.: 464,362

[22] Filed: Feb. 7, 1983

[30] Foreign Application Priority Data

Feb. 27, 1982 [DE] Fed. Rep. of Germany ..... 3207149

[51] Int. Cl.[4] ..... B22D 11/04

[52] U.S. Cl. ..... 164/416; 164/418; 164/443

[58] Field of Search ..... 164/416, 418, 443

[56] References Cited

U.S. PATENT DOCUMENTS 3,565,158 2/1971 Ciochetto ..... 164/416

FOREIGN PATENT DOCUMENTS 2442092 7/1980 France ..... 164/443

4225544 12/1967 Japan ..... 164/443

*Primary Examiner*—Richard K. Seidel

*Attorney, Agent, or Firm*—Ralf H. Siegemund

[57] ABSTRACT

The mold is constructed as a unit to be inserted in a water tank, the water tank being mounted to an oscillating table. The unit itself is comprised of the mold tube proper mounted between two end flanges which are interconnected by means of a structure which either includes directly a cooling jacket enveloping the mold tube or the jacket is separately connected to the connection between the two end flanges. That unit as a whole is inserted into the water tank whereby the flanges establish top and bottom closures for the water tank, and the lower flange centers the unit in the tank.

6 Claims, 2 Drawing Sheets

MOLD FOR CONTINUOUS CASTING OF METAL

BACKGROUND OF THE INVENTION

The present invention relates to a mold for continuous casting of metal, the mold being releasably fastened upon an oscillating table or the like; more particularly, the invention relates to a mold for continuous casting and including a tubular mold proper, a water tank, upper and lower flanges and a water conducting jacket.

Molds for continuous casting of metals and being of the type to which the invention pertains use, for example, a copper or copper alloy tube as the mold cavity proper. These molds are provided for the casting of billets or slab ingots and have a fixed cross section. Other molds are known which are made of separated plates for purposes of adjusting the dimensions of a rectangular cross section for such ingots. In the case of a change in the dimensions of the castings to be made, one has to exchange the mold completely if it is not constructed in an adjustable manner. This change in equipment constitutes, of course, down time for the casting machine as a whole and reduces therefore the output.

Austrian Pat. No. 238388 suggests a mold for continuous casting wherein the tubular mold proper is fastened to the cooling jacket by means of a flange. The patent suggests particularly that the mold tube is to be easily removable from this water tank. Certain narrow gap portions established by the assembly constitute preferred zones and areas of deposits precipitating from the cooling water. Such deposits as scale narrow the flow area for the water, and therefore have to be removed because they interfer with the desired and rated cooling process. Certain steps are provided as far as the diameters of the lower flange in this assembly is concerned, particularly with regard and in relation to the upper flange so as to permit a rather rapid removal of the mold pipe together with the jacket conducting the cooling water. It has to be realized that the particular solution proposed in this patent is directly related to the problem, namely, easy removing of those parts which require occasional cleaning and maintenance and involving especially that the sides of the assembly directly exposed to the coolant and which has to be removable with ease.

DESCRIPTION OF THE INVENTION

It is an object of the present invention to provide a new and improved mold for the continuous casting of metal in which the mold proper can be exchanged particularly for a mold having different dimensions and wherein the period of time required for such a change is minimized and particularly reduced as compared with prior practices.

In accordance with the preferred embodiment of the present invention, it is suggested to provide a particular mold tube proper, its coolant, i.e., water conducting and guiding jacket, and upper and lower flanges, as a structural unit which, as a whole, is insertable into and removable from a water tank whereby the flanges close off the water tank in a sealed and tight fashion. This construction permits the assembly of a unit as described in a different place and work area remote from the area in which the continuous casting is practiced and it permits also an independent adjustment of the mold tube in relation to the water conducting jacket prior too installation of either in the casting machine. It must not be forgotten that particularly the mold pipe requires a resilient disposition, i.e., a yielding disposition between the upper and the lower flanges in order to take care of the inherent problem of thermal expansion. The adjustment procedure in this regard and particularly the adjustment of the tube in relation to the cooling jacket may require quite an extensive period of time and that adjustment procedure does not have to be carried out while the machine is down but is a preparatory step for an exchange in equipment while the machine and apparatus for continuous casting still runs with the old mold.

In furtherance of the invention, the water tank should be provided in its lower portion with a centering guide structure for purposes of centering the aforementioned unit when inserted. This structure should not only facilitate the insertion but also insure a predetermined disposition generally. The water tank proper remains in position with respect to the casting machine and its installation, including particularly the withdrawal tank. The unit, when inserted, is particularly centered with respect to this equipment.

In accordance with another feature of the present invention, it is suggested to maintain the upper and the lower flange plates at a predetermined distance from each other by means of connecting elements running parallel to the mold cavity. This feature offers the construction advantage in that the spacing as so provided permits the resilient mounting of the mold tube in order to permit the latter to thermally expand.

From an overall construction point of view the water tank and the water conducting jacket establish a water circulation path. Upon removing the aforementioned unit, one has to empty the water tank. In accordance with a further feature of the present invention, it is suggested to provide the aforementioned unit and here particularly the lower flange thereof with sealing elements cooperating with the centering structure in the water tank. Thus, upon inserting the unit into the water tank in the centered position it is also connected thereto in a sealed fashion.

In order to monitor the insertion as described, particularly in view of an improved construction of the water tank, it is suggested to provide the centering guide in the water tank in such a manner that it is open in down direction. The lower opening of the water tank, moreover, permits the association of other elements with the aforementioned integrated unit which additional elements are also mounted to that unit prior to its installation in the machine for continuous casting. In this fashion one completes, so to speak, this integrated unit as much as possible which, of course, is again of advantage with regard to the period of time to perform the actual exchange. In this regard it is suggested that the aforementioned integrated unit is provided with a pair of rolls constituting the first roll of the roller track by means of which the continuous casting is guided upon emerging from the mold.

The overall construction of the integrated unit is, of course, determined by the requirements of continuous casting as such, and these requirements reflect also upon the construction of the water tank. Therefore, in furtherance of the invention it is suggested to provide the aforementioned integrated unit and here particularly, any connecting parts as far as insertion in the water tank is concerned, in the vicinity of an electromagnetic sterring coil which is disposed (and may remain) in the water tank. The connecting elements should not interfer with the coolant flow and they do not actually require a particular space within the cooling zone.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof, will be better understood from the following description taken in connection with the accompanying drawings in which:

Proceeding now to the detailed description of the drawings, FIG. 1 illustrates a working platform or table 1 which is provided for undergoing vertical oscillations. The drive elements for providing this oscillation are omitted and they do not per se constitute a portion of the invention. The oscillations are, for example, displacements in the range of 13 to 20 millimeter amplitude. All elements connected to or otherwise mounted on the table 1 are subjected to these oscillations and follow the same. The mold structure for continuous casting includes as a part of the assembly a water tank 2 which is mounted to the table 1 by means of a flange 1*a*; the reference numberal 1*b* denotes schematically bolts causing and providing this connection.

Figure 1:
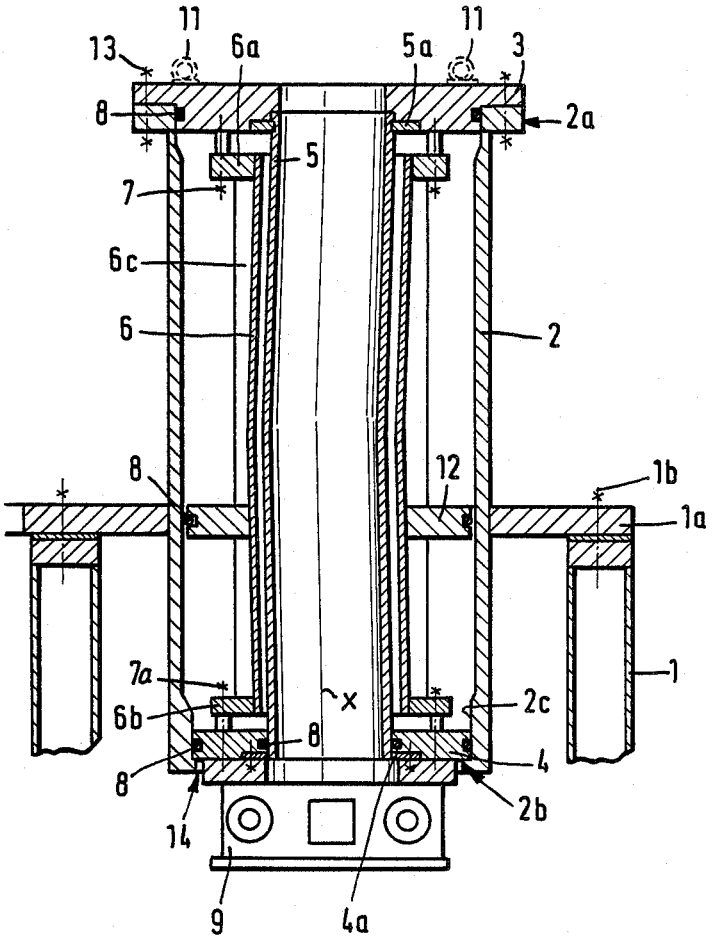
FIG. 1 is a longitudinal section view through a mold for continuous casting and as affixed to an oscillating table or platform and being constructed in accordance with the preferred embodiment of the present invention for practicing the best mode thereof.

Water tank 2 is provided at its upper end with an annular flange or collar 2*a* which extends radially outwardly while the lower end of water tank 2 is provided with an inwardly directed and oriented flange or rim 2*b*, that flange or rim 2*b* extends axially from a portion 2*c* of the water tank which has increased wall thickness. This portion 2*c* defines and establishes a centering, cylindrical surface with respect to a casting axis X. Rim 2*b* underneath defines an opening 14.

The integrated unit as per the invention includes an upper flange disc or annulus 3 and a lower flange disc or annular 4 of smaller diameter. The flange disc 3 has a overhanging portion by means of which the flange is bolted to the flange or collar 2*a* under utilization of bolts 8. In the recessed portion of the flange plate or disc 3, a groove is provided which receives a sealing ring such as 8 by means of which element 3 is sealed as against the flange 2*a*, thereby sealing in fact, the inside of the water tank on its otherwise open top.

The lower flange plate 4 sits on the flange rim or ledge 2*b*, there being a groove in the plate which is also provided with a sealing ring 8. As stated the thickened portion 2*c* of the water tank establishes the guide and centering element and feature, the plate 4, when inserted, is in abutment with that wall portion and is thereby centered with respect to the water tank. Thus, the cylindrical periphery of plate 4 coacts directly with the centering cylinder of tank portion 2*c*.

A copper or copper-alloy mold tube or pipe 5 is resiliently mounted between the two flange plates 3 and 4. The resiliency permits longitudinal extension and expansion of the curved tube 5. This resilient mounting is schematically indicated by means of the rings 4*a* and 5*a*. The tube 5 is bent for curved casting which, however, is incidental as for practicing the invention. The tube 5 is for most of its part enveloped by a jacket 6 of matching tubular construction and being provided with radially outwardly extending cooling fins which also stiffen the jacket 6. The jacket 6 is radially spaced from tube 5, the gap establishes the cooling zone proper.

Upper and lower flange rings or collars 6*a* and 6*b* are provided on the jacket and, respectively, fastening elements 7 and 7*a* secure these rings 6*a* and 6*b* respectively to the flange plages 3 and 4. Fastening elements 7 are relatively short bolts or pins. Longer elements will be employed in the example shown in FIG. 2 to be described later. These elements 7 and 7*a* are annularly arranged and provide additionally a spacing and positioning function of the jacket 6 as between disk 3 and 4. One can also say, that the fastening elements 7, 7*a* establish a rigid frame by joining disks 3 and 4 to the stiffened jacket 6, and the mold tube 5 is resiliently suspended in that frame constituting the unit to be inserted as on integrated or composite unit in the water tank.

The mold tube proper 5 is inserted in the water jacket and resiliently centered in relation to the jacket 6 such that a uniform gap and flow space for water is set up in between the mold tube proper and the jacket 6. This unit is relatively compact and preadjusted and in that adjusted configuration it is taken from its own assembly place to the location of the casting equipment proper represented here by the table 1 and the water tank 2. Reference numberal 11 refers to eyes or hooks by means of which the unit can be taken from one place to another, for example, by means of a moveable crane or the like. The crane will position this unit centrally above the opening of the water tank and will lower the unit permitting a particular manipulation until the flange 4 shifts into the cylindrical space as provided by the water tank portion 2*c* whereupon the unit as so inserted is, in fact, centered and needs merely to be bolted on the top by means of the bolts 13 as described.

The various sealing elements and rings 8 seal the unit as such and, in fact, seal and close off the water tank as a whole because the flange plate 3 and 4 constitute top and bottom of the water tank. Reference numeral 12 refers to an intermediate flange extending from the jacket 6 and dividing the water tank into an upper and a lower portion. The water feed and inlet as well as the discharge and outlet elements for the water tank are not shown but they are connected to different sides of the sealed, intermediate flange 12 so that, in fact, a circulation is established from the water outside the jacket 6 and along the gap between the jacket and the mold tube 5.

As an added feature, a set of rolls 9 in a particular mounting structure is bolted in an additional and supplementing structure element to the flange plate 4. The radial dimensions of this supplemental structure are such that they readily pass through the opening 14 as provided by the flange and rim 2*b* and, of course, upon insertion of the unit as a whole into the water tank, the subunit which includes track rollers 9 clears the water tank wall with ease. Therefore, this particular uppermost portion of the withdrawal track for the continuous casting can also be affixed to the integrated unit prior to installation as described.

Figure 2:
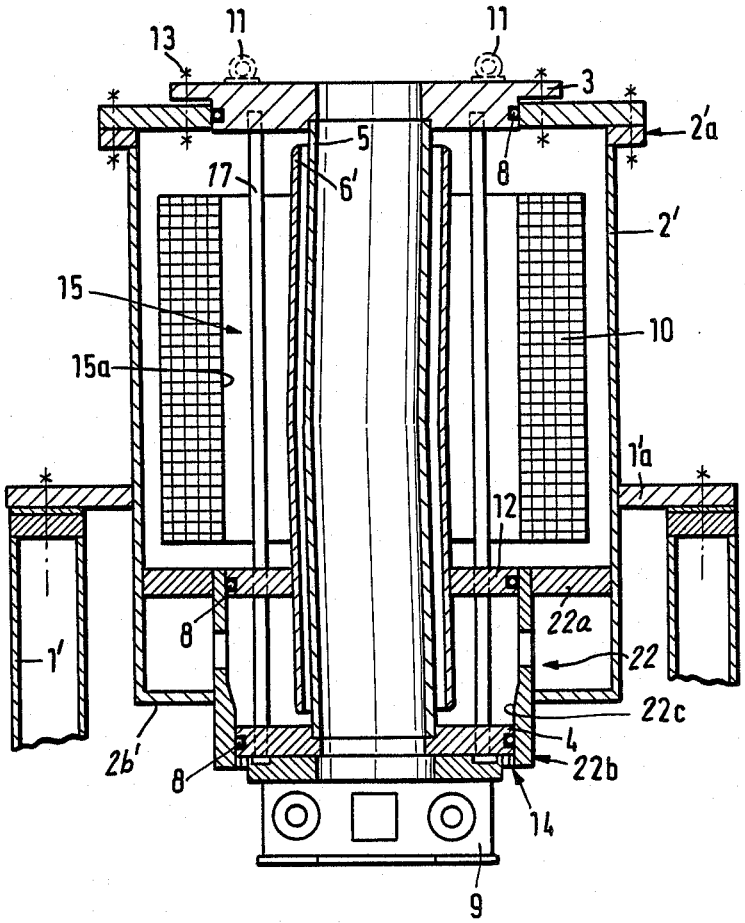
FIG. 2 is a similar section view, still of the preferred embodiment but meeting different requirements of the casting process.

Proceeding now to the description of FIG. 2, the figure shows a oscillating table 1' having somewhat wider dimensions and accordingly, the mounting flange 1'a is wider to accommodate a wider and shorter water tank 2'. The water tank is again provided with a flange or rim 2b', being of somewhat larger radial dimensions and having inserted a guide and centering structure 22 being comprised of a tubular element or sleeve 22b, a flange 22a and a thicker guide portion proper 22c delineating the centering cylinder for the mold unit tube inserted..

The integrated and composite mold unit is comprised here again of flange plate, plates 3 and 4 in which the mold 5 is inserted. The cooling jacket 6' is employed basically as a shield and flow separation structure; it is not used as a mounting unit for combining and interconnecting the plates 3 and 4. Rather, these two plates are interconnected by means of rods or long piston bolts 17 which directly interconnect and space the two plates 3 and 4. A positioning flange 12' is traversed by these rods 17 and is connected to them which in this case establishes the mounting connection of the jacket 6' to the remainder of the nit.

The interior space of the water tank 2' generally denoted with reference numeral 15 is fairly wide, the purpose being the mounting of a stirring coil 10 into this space circumscribing the cylinder established by the annularly arranged rods 17. The diameter of the inside opening 15a of this coil 10 must be sufficient so that upon insertion of the integrated mold unit, the widest element which is the mounting flange 12' can pass through. The centering sleeve 22b is provided with apertures to establish a lower plenum for the coolant. The space in which the coil 10 is mounted is the upper plenum. These two plenum chambers are separated by the mounting flange 22a as well as by the flange 12'. The two chambers are interconnected flow conductively by the interior space or gap as defined between the cooling jacket 6' and the mold tube 5.

The invention is not limited to the embodiments described above; but all changes and modiifications thereof, not constituting departures from the spirit and scope of the invention, are intended to be included.

We claim:

1. In an apparatus for continuous casting of metal having an oscillating table, there being a water tank mounted to said table, the improvement comprising:

an integrated mold unit including a tubular mold defining a mold cavity, an upper and a lower flange plate mounted to the ends of the tube respectively;

a cooling jacket enveloping said tube;

connection means including a plurality of parallely positioned and annularly arranged rods for interconnecting said cooling jacket and said upper and lower flange plates to thereby combine them into a structural independently placeable and removable unit for placement into the tank and removal therefrom; and said water tank being open at its top and at its bottom, said flange plates serving as bottom and top for said water tank upon insertion of said unit in said water tank for closing the tank whereby additional sealing means are provided to seal water-tightly said flanges as against said water tank.

2. A mold unit for insertion into a water tank in a machine for continuous casting, comprising:

a mold tube;

a pair of flanges, said mold tube being resiliently held between said flanges;

a cooling jacket being shorter than the tube and receiving the tube, there being a flow space between the jacket and the tube;

upper and lower flanges extending radially from the jacket; and fastener and spacer means for respectively mounting the flanges of the pair to the upper and lower flanges to establish a frame within which the hold tube is held.

3. A mold unit for insertion into a water tank in a machine for continuous casting, comprising:

a mold tube;

a pair of flanges, said mold tube being resiliently held between said flanges;

a cooling jacket being shorter than the tube and receiving the tube, there being a flow space between the jacket and the tube;

a flange extending radially outwardly from the jacket; and a plurality of rod means interconnecting said flanges of the pair, and being fastened to the flange of the jacket for positioning the jacket with respect to the mold tube.

4. In an apparatus for continuous casting of metal having an oscillating table, there being a water tank mounted to said table, the improvement comprising:

an integrated mold unit including a tubular mold defining a mold cavity, an upper and a lower flange plate mounted to the ends of the tube respectively;

a cooling jacket enveloping said tube and being provided with at least one radially outwardly extending flange;

connection means including rods mounted to said flange of said jacket for interconnecting said cooling jacket and said upper and lower flange plates to thereby combine them into a structural independently placeable and removable unit for placement into the tank and removal therefrom; and said water tank being open at its top and at its bottom, said flange plates serving as bottom and top for said water tank upon insertion of said unit in said water tank for closing the tank whereby additional sealing means are provided to seal water-tightly said flanges as against said water tank.

5. In an apparatus for continuous casting of metal having an oscillating table, there being a water tank mounted to said table, the improvement comprising an integrated mold unit including a tubular mold defining a mold cavity, an upper and lower flange plate mounted to the ends of the tube respectively;

a cooling jacket enveloping said tube, said jacket being provided with two flanges at its ends;

connection and fastening means for connecting two flanges of said cooling jacket respectively to said upper and lower flange plates, to thereby combine them into a structural independently placeable and removable unit for placement into the tank and removal therefrom; and said water tank being open at its top and at its bottom, said flange plates serving as bottom and top for said water tank upon insertion of said unit in said water tank for closing the tank whereby additional sealing means are provided to seal water-tightly said flanges as against said water tank.

6. In an apparatus for continuous casting of metal having an oscillating table, there being a water tank mounted to said table, the improvement comprising an integrated mold unit including a tubular mold defining a mold cavity, an upper and a lower flange plate mounted to the ends of the tube respectively;

a cooling jacket enveloping said tube;

a plurality of connecting rods directly interconnecting said flange plates, said jacket being provided with a flange, said flange being additionally connected to the rods for interconnecting said cooling jacket and said upper and lower flange plates to thereby combine them into a structural independently placeable and removable unit for placement into the tank and removal therefrom; and said water tank being open at its top and at its bottom, said flange plates serving as bottom and top for said water tank upon insertion of said unit in said water tank for closing the tank whereby additional sealing means are provided to seal water-tightly said flanges as against said water tank.

* * * * *